United States Patent [19]

Krüger et al.

[11] 4,299,139

[45] Nov. 10, 1981

[54] FOOT PEDAL FOR MOTOR VEHICLES

[75] Inventors: Gerhard Krüger; Winfried Griep, both of Bonn, Fed. Rep. of Germany

[73] Assignee: Vaw Leichtmetall GmbH, Bonn, Fed. Rep. of Germany

[21] Appl. No.: 87,777

[22] Filed: Oct. 24, 1979

[30] Foreign Application Priority Data

Nov. 13, 1978 [DE] Fed. Rep. of Germany ... 7833673[U]

[51] Int. Cl.[3] ..... G05G 1/14

[52] U.S. Cl. ..... 74/560

[58] Field of Search ..... 74/560, 512, 519; 29/150; 113/116 Q, 116 AA, 116 HH

[56] References Cited

U.S. PATENT DOCUMENTS 3,288,099 11/1966 Bittner ..... 74/512
3,774,471 11/1973 Pezza ..... 74/560
4,010,982 3/1977 Grossart ..... 74/512

FOREIGN PATENT DOCUMENTS 2516659 4/1975 Fed. Rep. of Germany ..... 74/512

*Primary Examiner*—Kenneth Dorner
*Attorney, Agent, or Firm*—Darby & Darby

[57] ABSTRACT

A foot pedal of one piece construction is formed from a generally elongated member. An aperture is defined by a collar at one end of the elongated member. The inner surface of the collar acts as a bearing surface. At the opposite end of the elongated member, a generally planar surface defines a plate which can be foot actuated. A twisted portion of the elongated member connects the apertured end of the member with the plate. In one embodiment, a connector protrudes from the elongated member in the vicinity of the twisted portion. In another embodiment, the elongated member is made of aluminum and the connector is made of steel alloy.

2 Claims, 2 Drawing Figures

FOOT PEDAL FOR MOTOR VEHICLES

The present invention relates to foot pedals for use with motor vehicles such as automobiles, motorcycles, motorbikes or the like.

Conventional foot pedals, are made by joining several individual parts to form the pedal. The individual parts must each be cut to desired lengths and shaped into the desired form. Finally, the individual shaped parts must be joined together by processes such as welding, soldering or screwing to form the foot pedal. The manufacturing of such conventional foot pedals, particularly the joining step, is a relatively costly process.

It is an object of the present invention to provide a foot pedal which can be manufactured from one piece of material without a separate joining process.

It is another object of the present invention to provide a foot pedal which is economical to construct.

Briefly, in accordance with the invention, a pedal is formed from an elongated member, one end of which is formed into the shape of a plate can be foot-actuated. A collar at the opposite end of the elongated member defines an aperture which can act as a bearing surface. A portion of the elongated member, located between the plate shaped end and the apertured end, includes a twisted portion and has greater rigidity and stability than the adjoining portions of the elongated member.

Figure 1:
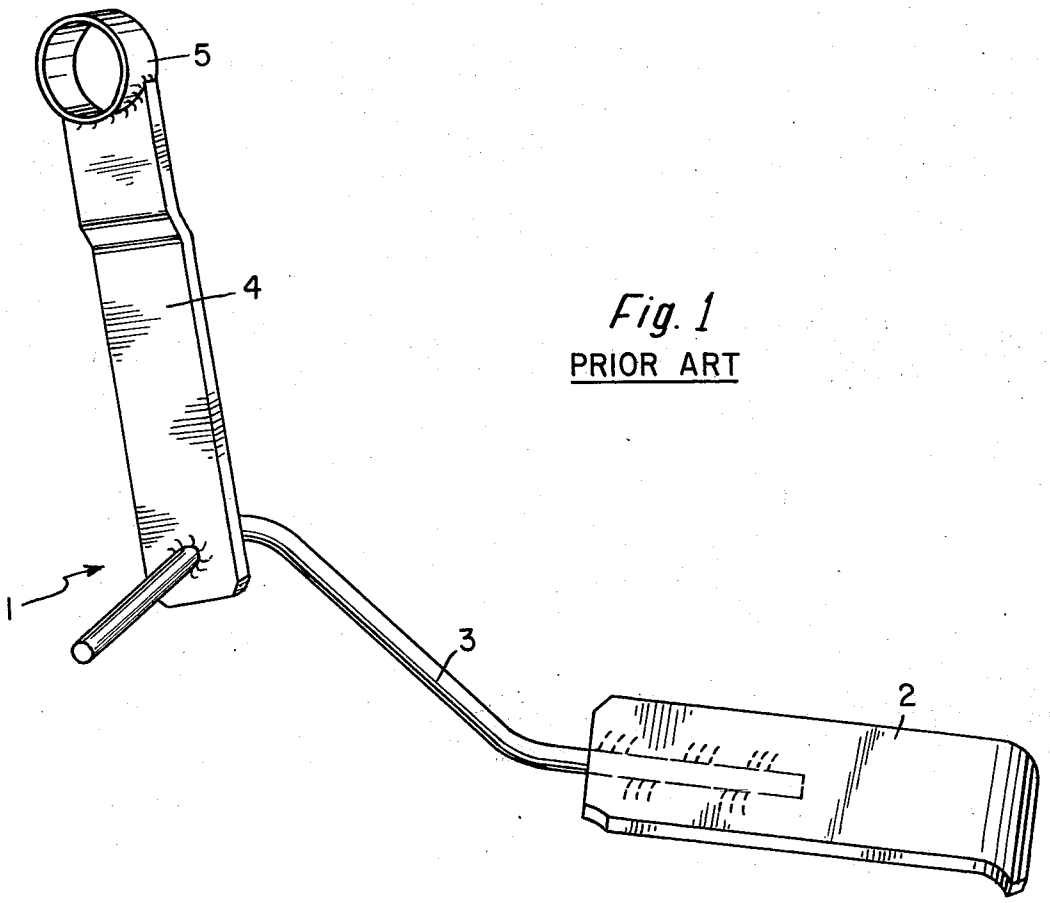
Fig. 1 PRIOR ART
Figure 2:
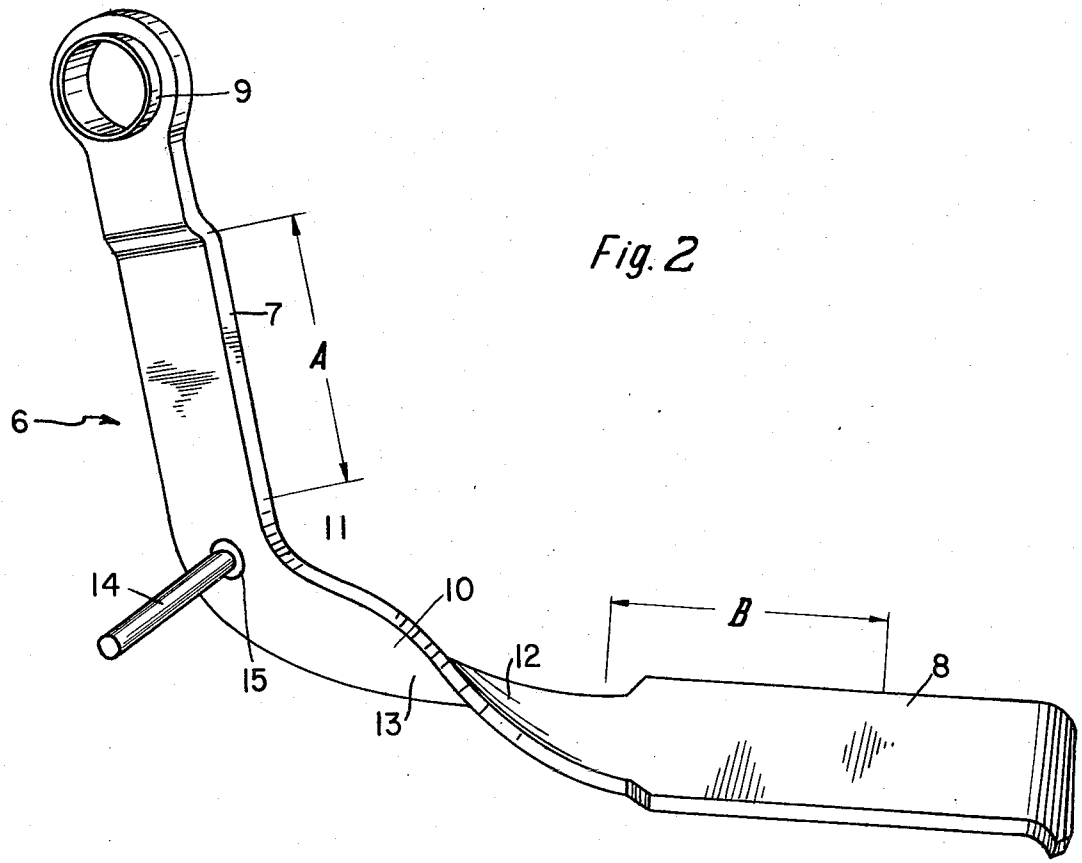

Other objects and advantages of the present invention will become more readily apparent upon reference to the following specification and the annexed drawings in which:

FIG. 1 is a perspective view of a conventional foot pedal constructed by joining several individual parts together; and FIG. 2 is a perspective view of a foot pedal in accordance with the present invention.

FIG. 1 depicts a conventional foot pedal 1 comprising several individual elements which are joined together. The individual elements include a generally rectangular footplate 2, a connector 3, a connecting bridge 4 and a ring shaped bearing surface 5. The individual elements are cut or stamped from desired material at desired lengths and the elements are then formed into the proper shapes. The footplate 2, connector 3, connecting bridge 4 and bearing surface 5 are then joined together by conventional joining processes such as welding, soldering or screwing to form the completed foot pedal.

As shown in FIG. 2, the pedal 6 in accordance with the present invention comprises an elongated member 7 of one piece construction which is of generally rectangular cross-section.

A foot plate 8 is defined at one end of the elongated member 7. Although depicted as a generally flat and rectangular member, the plate 8 can be formed in various alternative geometric shapes. At the opposite end of the elongated member 7, a collar 9 defines an aperture whose inner surface acts as a bearing surface allowing rotation of the pedal 6 about a rod (not shown) which can be fitted within the collar 9. Approximately equidistant between the collar 9 and the plate 8, the elongated member 7 includes a twisted connecting bridge portion 10 which, because of the twist, has greater rigidity and stability than the adjoining non-deformed Sections A and B.

The twisted portion 10 of the pedal 6 is formed by a combination of bending Section A and Section B towards each other and rotating one section with respect to the other.

As shown in FIG. 2, Sections A and B are bent together so that the plane defined by Section A of the foot pedal 6 is approximately perpendicular to the plane defined by Section B. Further, Section A is rotated through approximately 90 degrees with respect to Section B.

Elongated member 7 also includes a shoulder at the end of Section A which is nearest to the collar 9.

The foot pedal can be formed, in a one piece construction, by stamping out the elongated member and then imparting a twist to the member at the connecting portion 10.

The collar 9, which defines an aperture in the elongated member, can be formed by extruding a portion of the elongated member 7 in the vicinity of the aperture so that a collar is formed. The inner wall of the collar acts as a bearing surface.

In another embodiment of the foot pedal, a connector 14 is mounted to the pedal 6 at a bore formed in the elongated member 7. The diameter of the bore is less than the diameter of the connector 14. The connector 14 is forced into the bore through a jolting process so that a roll shaped and thickened portion 15 is formed at the joint between the connection 14 and the elongated member 7. This method of mounting the connection 14 assures a firm fit between the connector 14 and the elongated member 7.

The foot pedal in accordance with the present invention can be made from a variety of acceptable materials such as aluminum work materials or combinations of aluminum work materials and steel. In one embodiment, the elongated member 7 is made from aluminum and the connector 14 is formed from steel alloy.

The pedal may be utilized in a variety of applications. For example, the pedal may be used as a foot pedal to actuate the brake, accelerator or clutch of conventional vehicles. However, the pedal in accordance with the present invention also has wide applicability to a variety of alternative devices both transportation-related and otherwise.

It will be apparent to those skilled in the art that the present invention may take a variety of alternative forms, that the foregoing specification is merely illustrative and that the scope of protection afforded the present invention is to be determined by the annexed claims.

What is claimed is:

1. A foot pedal for use with motor vehicles, comprising an elongated unitary member formed from a flat piece of metal and including two planar sections forming an angle therebetween of less than 180 degrees, the two sections being joined by a ninety degree twisted bridge portion formed at the apex of the angle between the two sections so that each of said sections lies substantially entirely in a plane perpendicular to the plane of the other, with one of the sections including means for mounting said foot pedal for pivotal movement in response to a force applied to a planar surface of the other of said sections.

2. A pedal according to claim 1 further comprising a connector in the vicinity of said twisted portion; said connector protruding outwardly from said member, and wherein a roll shaped and thickened portion is formed at the joint between said connector and said elongated member.

* * * * *